United States Patent [19]

Rutz

[11] Patent Number: 4,529,131

[45] Date of Patent: Jul. 16, 1985

[54] SPRAY DEVICE FOR ELECTROSTATIC COATING OF ARTICLES WITH COATING MATERIAL

[75] Inventor: Guido Rutz, Gossau, Switzerland

[73] Assignee: Ransburg-Gema AG, Switzerland

[21] Appl. No.: 552,289

[22] Filed: Nov. 16, 1983

[30] Foreign Application Priority Data

Nov. 24, 1982 [DE] Fed. Rep. of Germany ..... 3243447

[51] Int. Cl.[3] ..... B05B 5/02

[52] U.S. Cl. ..... 239/690; 361/228

[58] Field of Search ..... 239/690, 704, 706, 707, 239/708, 3; 361/228, 226, 227; 239/697, 698

[56] References Cited

U.S. PATENT DOCUMENTS

| | | | |
|---|---|---|---|
| 3,608,823 | 9/1971 | Buschor | 239/706 X |
| 4,196,465 | 4/1980 | Buschor | 239/692 X |
| 4,216,915 | 8/1980 | Hengartner et al. | 239/698 |
| 4,287,552 | 9/1981 | Wagner et al. | 239/708 X |

*Primary Examiner*—Jeffrey V. Nase
*Assistant Examiner*—Daniel R. Edelbrock
*Attorney, Agent, or Firm*—Ostrolenk, Faber, Gerb & Soffen

[57] ABSTRACT

An electrostatic spray coating device in which a coating material passes through a tube in a body and is electrostatically charged by electrodes as it exits the body. In the body is mounted a bar transformer for providing a high voltage to the electrodes. A magnetic conductor bar, such as a ferrite core, is also mounted in the body outside the bar transformer for conducting magnetic flux between its ends, thus providing a flux circuit within the body. If more than one conductor bar is used, the bars are spaced to facilitate heat discharge. A multiplying and rectifying circuit such as a Greinacher circuit may also be mounted in the body between the transformer and the electrodes, with its components distributed around the tube.

17 Claims, 8 Drawing Figures

SPRAY DEVICE FOR ELECTROSTATIC COATING OF ARTICLES WITH COATING MATERIAL

BACKGROUND OF THE INVENTION

1. Field of the Invention

The invention relates to a spray device for the electrostatic coating of articles with coating material, particularly powdered coating material.

2. Description of the Prior Art

In principle, there are two different methods of electrostatic coating. One is the charging method, in which a high voltage is conducted from a central source of high voltage to one or more spray devices. In the other method, the high voltage is produced in the spray device by means for providing a voltage. The present invention relates to this second method. In principle, all spray devices based on this second method which are available on the market today operate as follows:

For manual operation the spray device has the shape of a pistol, while for automatic coating systems it frequently has the shape of a short bar. The spray device is fed a high frequency alternating current of low voltage. This low voltage is transformed at the inlet of the spray device to several thousand volts by a transformer. This medium-high voltage is then multiplied in the spray device in a voltage multiplying and rectifying circuit to the final voltage required on the electrodes used for electrostatic charging of the coating material and is converted into direct current. Such a circuit customarily consists of a voltage-multiplier cascade of diodes and capacitors, also known as a Greinacher circuit from the name of its inventor. The advantage of this system is that the high final voltage is reached only in the spray device and specifically the highest voltage value is reached only at the end of the spray device where the electrodes are located.

A device of this type which is marketed by applicant's assignee has an elongated body through which a channel for the coating material extends in longitudinal direction to a delivery opening which emerges from the body. In the body, parallel to and outside of the channel, is an electric transformer which has a bar-shaped core and at least one primary winding and one secondary winding surrounding the core. At least one electrode is mounted in the delivery opening of the body for the electrostatic charging of the coating material conducted through the channel. An electric voltage-multiplying and rectifying circuit is arranged within the body and connects the transformer to the electrodes. An electric connecting device connects the primary winding of the transformer to a source of current.

The generation of high voltage by the method described above has limitations. In coating narrow tubes, nozzles and other hollow bodies whose inside diameter is not substantially greater than the outside diameter of the spray device, the electric and magnetic fields in the spray device are greatly impeded by the grounded articles to be coated. In particular, bar transformers, which are preferred because of considerations of space, change their output considerably under these influences. This is due to the fact that the open magnetic flux of the magnetic field is disturbed by the article to be coated.

Attempts have been made to circumvent these disadvantages by means of transformers of various design which have a completely closed magnetic flux circuit. These efforts have, however, up to now failed in practice due to the size of these units and other technical considerations.

U.S. Pat. No. 3,608,823, which corresponds essentially to West German Pat. No. 20 65 699, shows a pistol-shaped spray device at whose upstream rear end an annular transformer concentrically surrounds the channel for the coating material. This patent also describes voltage multiplying and rectifying circuits in the form, on the one hand, of a voltage-multiplier cascade, and on the other hand, of a voltage divider. The parts of this circuit are distributed uniformly around the channel.

West German Unexamined Application for Patent No. OS 30 08 843 shows a pistol-shaped spray device in which an oscillator that is fed with a low DC voltage, a transformer and a cascade circuit are each formed as a hollow cylindrical annular unit and concentrically surround the channel for the coating material. Concentrically surrounding structural groups can, however, produce disadvantageous electric and magnetic field effects, must be specially manufactured, and can in each case be used only for a spray device of a given size, while the use of commercial electrical components would be considerably cheaper.

U.S. Pat. No. 3,731,145 shows a pistol-shaped spray device having a unit consisting of a transformer and a DC-voltage/AC-current converter arranged in its upstream end and having a voltage multiplier unit arranged over the channel for the coating material. The transformer has a cup core.

U.S. Pat. No. 4,196,465 shows a pistol-shaped spray device which consists essentially of two parts which lie with parallel axes over one another and can be detached from each other. The channel for the coating material passes through the upper part. Within the lower part are arranged the electrical components for producing the voltage for the electrodes which serve for the electrostatic charging of the coating material. These components consist essentially of an oscillator for converting the DC voltage of a source of voltage into an AC voltage, followed by a transformer for transforming the oscillator voltage to a medium-high voltage. A multistep cascade circuit is connected to the secondary winding of the transformer for further increasing the voltage and converting it to a given high DC voltage value which is fed to the electrodes.

SUMMARY OF THE INVENTION

The object of the present invention is to make the thickness of the elongated spraying device so small that the spray device can be introduced even into narrow inner spaces of hollow bodies in order to coat the inner surfaces thereof. The spray device should be of simple construction and economical to manufacture, produce a high-grade quality of coating, and satisfy high demands as to electrical safety and long life. For this object, insofar as possible, ordinary commercial electrical components are to be used and heat accumulation in the device must be avoided.

This object is achieved in accordance with the invention by adding to the prior art spray device magnetic conductor bars, preferably two or more in number, which collect and conduct the magnetic field or flux. The bars are preferably ferrite cores, and are arranged in the magnetic field of the transformer parallel to the bar core of the latter, outside of the primary and secondary windings. The magnetic conductor bars are spaced from each other around the circumference of the bar core and extend substantially over the entire length of the bar core.

The invention represents a novel compromise between a transformer with a completely closed magnetic circuit and a bar transformer with an open magnetic circuit. The magnetic conductor bars, which are arranged parallel to the bar core and are preferably cast into the cast plastic body of the spray device, collect and conduct the greatest part of the open magnetic flux of the bar transformer and in this way make it insensitive to external influences. Such external influences include, in particular, the tubular hollow bodies to be coated, which normally consist of metal. The large slot or gap in the magnetic flux circuit which remains between the bar-shaped core of the transformer and the magnetic conductor bars for all practical purposes does not affect the output of the transformer. On the contrary, it helps it to avoid the negative technical effects which result with closed circuit transformers. For example, such a slot or gap serves to avoid saturation of the transformer. The magnetic conductor bars take up the magnetic flux of the transformer magnetic field. In this way, upon the coating of the insides of narrow articles, the magnetic field or flux is prevented from flowing into said articles. The flow of flux into articles to be coated is detrimental, since the magnetic flux path is then dependent on the distance of the article from the transformer. A small distance results in a greater voltage drop across and increased current consumption by the transformer.

Instead of using individual magnetic conductor bars, it is theoretically also possible to surround the transformer completely by a cylindrical screening element. This, however, has the disadvantage that the heat developed by the transformer would be held and parts of the apparatus would be damaged by this accumulation of heat. Therefore, the magnetic conductor bars of the invention are spaced appropriately to avoid overheating.

Other objects, features and advantages of the invention will be apparent from the following description, together with the accompanying drawings and the appended claims.

BRIEF DESCRIPTION OF THE DRAWINGS

Several embodiments of the invention will be described below with reference to the drawings, in which.

DESCRIPTION OF THE PREFERRED EMBODIMENTS

Figure 1:
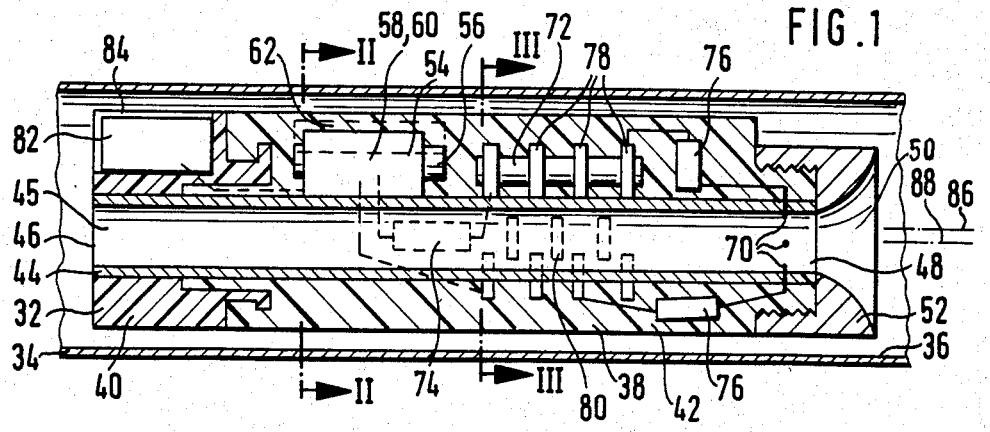
FIG. 1 is a longitudinal section through a bar-shaped spray device according to the invention disposed within a narrow tubular article to be coated.

The bar-shaped spray device 32 of FIG. 1 which is made according to the invention has been introduced into a tubular article 34 in order to coat the inner wall 36 thereof with powdered coating material. The elongated body 38 of the spray device 32 consists essentially of a plastic part 40, for instance of a plastic sold under the trademark DELRIN, and of a part 42 also of plastic which is cast axially onto the part 40. Through the elongated body 38 there extends a tube 44 which conducts the powdered coating material, transported in known manner by a stream of gas, from an inlet opening 46 to a discharge opening 48 of the body 38. Adjoining the discharge opening 48 there is a funnel-shaped nozzle opening 50 of known shaping for atomizing of the coating material without baffle plate. The nozzle opening 50 is in a mouthpiece 52 which is fastened to the discharge opening 48 on the cast-on plastic part 42 of the body 38.

Figure 6:
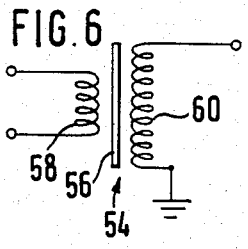
FIG. 6 is an exploded diagrammatic view of a bar-shaped transformer used in the embodiments of FIGS. 1 to 5.

Within the cast-on plastic part 42 there is cast an electric transformer 54 which has a bar-shaped core 56, at least one primary winding 58 surrounding the core for causing a magnetic flux through the core and at least one secondary winding 60 wound over the primary winding and responsive to the magnetic flux through the core. The bar transformer 54 is shown schematically in more detail in FIG. 6. The transformer is arranged above the channel 45 in the plastic part 42 with its axis parallel thereto. A bar transformer 54 has the advantage over all other transformer shapes in that it is substantially smaller and therefore requires considerably less space.

In the magnetic field of the transformer 54 there are arranged, parallel to the bar core of the transformer and outside the primary and secondary windings 58 and 60, at least two magnetic conductor bars 62, preferably ferrite cores, which collect and conduct the magnetic field or flux and are spaced apart from each other around the circumference of the bar core 56. The magnetic conductor bars extend substantially over the entire length of the bar core 56 and are substantially of the same length as the bar core 56. The magnetic field of the transformer 54 must be screened primarily radially outward toward the article 34 but less toward the channel 45. Therefore, the ferrite cores 62 are arranged, with reference to the central axis 64 of the bar core 56 as the vertex, with an angular spacing 66 of less than 180° on the side of the transformer 54 facing away from the channel 45. This can be noted in particular from FIGS. 1 and 2. The smaller is the outside diameter of the body 38, the less space remains between the transformer 54 and the outer surface 68 of the body 38. This means that the angular spacing 66 must necessarily be greater as the distance between the transformer 54 and the outer wall surface 68 of the body 38 is smaller. Therefore the smaller the inside diameter of the article 34 to be coated, the larger the spacing angle 66 will also be, since in that case the body 38 must have a smaller outside diameter.

Figure 4:
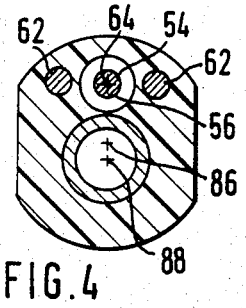
FIG. 4 is a cross-sectional view similar to FIG. 2 through another embodiment of the invention.

As shown in FIG. 4, the ferrite cores 62 can also be arranged 180° apart around the transformer 54, or at an even larger angle apart, but the screening of the magnetic field from the article 34 to be coated will be poorer the larger the angular spacing 66 is made. On the other hand, the discharge of heat toward the outside is facilitated when the ferrite cores 62 are not arranged too close to each other.

Figure 7:
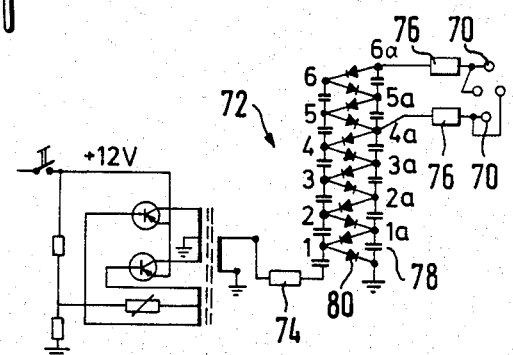
FIG. 7 shows a voltage multiplying and rectifying circuit based on the Greinacher principle for the embodiments of FIGS. 1 to 6.

Four electrodes 70, which are cast into the plastic part 42 of the body 38, for instance, extend into the channel 45 at the discharge opening 48. Furthermore, a so-called Greinacher circuit (named after its inventor Greinacher) is cast into the cast plastic part 42 as voltage multiplying and rectifying circuit 72. The input of the circuit 72 is connected via a series resistor 74 to the secondary winding 60 of the transformer 54. The outlet of the circuit 72 is formed of two voltage steps of different value, each of which is connected via a protective resistor 76 to two electrodes 70 arranged 90° apart around the body. Such a circuit is in itself known and has been shown by way of example in FIG. 7. The circuit 72 consists essentially of capacitors 78 and diodes 80 which are distributed uniformly around the channel 45 and are connected with each other, as shown in FIG. 7, by wires, as shown diagrammatically in FIG. 3. In this way, all electric parts are arranged uniformly around the channel 45 and are cast into the plastic part 42. As shown in FIG. 1, however, none of the electric parts is annular in shape and none surrounds channel 45. A connecting device 82, developed as a plug unit which serves to connect the primary winding 58 of the transformer 54 to a source of current, is arranged within a recess 84 in the upstream plastic part 40.

Figure 2:
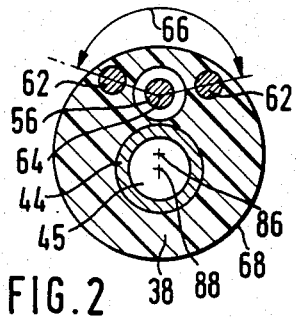
FIG. 2 is a cross-section along the plane II—II of FIG. 1.
Figure 3:
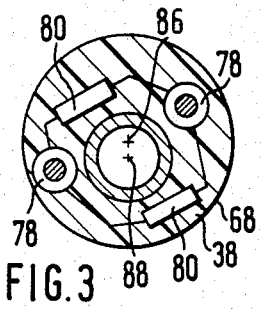
FIG. 3 is a cross-section along the plane III—III of FIG. 1 from which the cylindrical substantially circular cross-sectional shape of the device can be noted.

As shown in FIGS. 1, 2 and 3, the body 38 has a substantially cylindrical outer shape, with the channel 45 and its delivery opening 48 having their axis 88 arranged eccentrically to the cylinder axis 86, while the transformer has its central axis 64 arranged eccentrically to the axis 86 of the cylinder diametrically towards the other side.

The spray device 32 shown in FIGS. 1, 2 and 3 has a substantially cylindrical outer shape. In this connection a circular cross-section such as that shown in FIGS. 2 and 3 is most advantageous. Slight deviations therefrom in the form of a polygon are, of course, possible. Furthermore, a modification of the outer shape of the cross-section, such as that shown in FIG. 4, is possible, i.e., a circular outer shape with flattened side surfaces extending parallel to each other.

Figure 5:
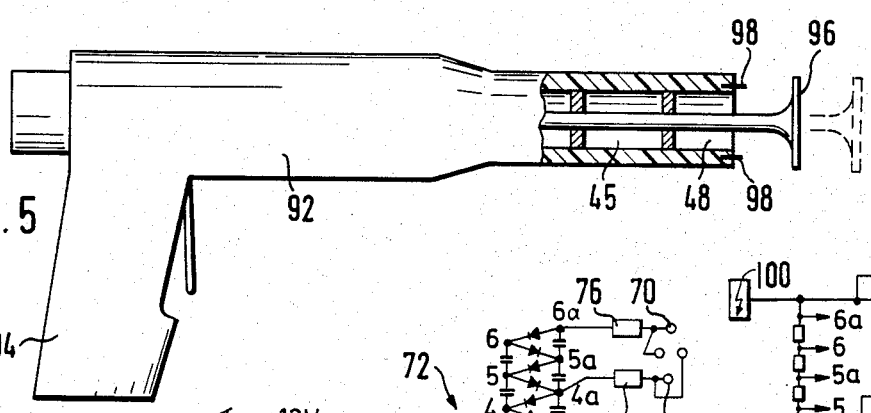
FIG. 5 shows a pistol-shaped embodiment of a spray device according to the invention, shown partially in section.

FIG. 5 shows another embodiment of a spray device 92 in the form of a handgun. The only difference from the embodiments of FIGS. 1 and 2 is that in FIG. 5 a handle 94 is provided and no mouthpiece is connected to the discharge opening 48. A baffle plate 96 is instead provided in order to atomize the coating material. Instead of electrodes which extend into the channel 45, electrodes 98 may be provided, which protrude axially from the rim of the discharge opening 48 and electrostatically charge the coating material emerging from the delivery opening 48 while it is eddied by the baffle plate 96. The baffle plate 96 can be displaced axially between the position shown in solid line and the position shown in dashed line, as is known. With regard to the rest of the development and also in particular with regard to the electrical parts, the embodiment shown in FIG. 5 corresponds to the embodiments shown in FIGS. 1 to 3.

An external source of voltage which, for instance, supplies 10 volts at 17 kHz can be connected by a cable to the socket 82 of FIG. 1. This voltage passes from the plug unit 82 to the primary winding 58 of the transformer 54, which, in the manner indicated, has a bar-shaped core 56 and is shown in exploded view in FIG. 6. The secondary winding 60 of the bar transformer 54 gives off a voltage of, for instance, 5 kV at 17 kHz over the protective resistor 74 to the inlet of the voltage multiplying and rectifying circuit 72. The circuit 72 is, in the manner indicated, a Greinacher cascade circuit from the end of which one or, as shown in FIG. 7, two different DC voltages of about 70 kV are tapped off and fed to the electrodes 70 of FIG. 1 or the electrodes 98 of FIG. 5. The possible range of this high voltage is between about 40 kV and 150 kV. The use of two slightly different voltage potentials for the electrodes results in the production within the channel 45 of an eccentrically distributed electrostatic field which, in known manner, is favorable for the electrostatic charging of the coating material.

Differing from the embodiment described up to now, the connection device 82 may contain a voltage converter developed in accordance with FIG. 7, to which there is connected a DC voltage of, for instance, 12 volts from an external source of DC voltage. In this case, there is selected as transformer 54 an embodiment having two primary windings in accordance with FIG. 7 which, however, also contains a bar-shaped magnetic core around which the windings are wound.

Figure 8:
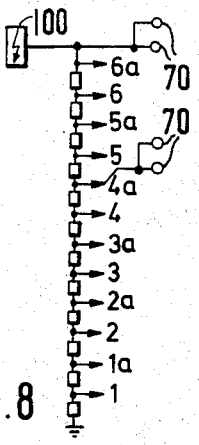
FIG. 8 shows a voltage multiplying and rectifying circuit having a voltage divider which can be used as an alternative to the embodiment shown in FIG. 7.

In accordance with a further modification, the connection device 82 may be a socket for an external source of DC or AC voltage while the bar-shaped transformer 54 is part of a high voltage generator 100 whose different high output voltages for the electrodes are produced by a voltage divider, corresponding to that shown in FIG. 8.

The individual voltage steps of the voltage multiplying and rectifying circuits of FIGS. 7 and 8 are designated by the reference numbers 1, 2, 3, 4, 5 and 6 as well as 1*a*, 2*a*, 3*a*, 4*a*, 5*a* and 6*a*.

There are thus many possibilities for modification. The preferred embodiment is shown in FIGS. 1, 2, 3 and 6, using a bar transformer and having a substantially cylindrical spray device, whether exactly circular or in the form of a polygon. The entire spray device, with the exception of an optional handle, has no radial protrusions which extend the cylindrical shape toward the side.

Although the present invention has been described in connection with a number of preferred embodiments thereof, many other variations and modifications will now become apparent to those skilled in the art. It is preferred, therefore, that the present invention be limited not by the specific disclosure herein, but only by the appended claims.

What is claimed is:

1. An electrostatic spray device for electrostatically charging and delivering a coating material, comprising:

(A) a body having an inlet opening, a discharge opening and a channel for conducting the coating material from the inlet opening to the discharge opening;

(B) an electrode circuit mounted in the body for electrostatically charging the coating material exiting the discharge opening; and (C) means for providing a voltage to the electrode circuit, the voltage providing means comprising:

(1) a bar transformer mounted in the body comprising a bar-shaped core, a first winding around the core for causing a magnetic flux through the core, and a second winding around the core responsive to the magnetic flux through the core for providing a voltage; and (2) a magnetic conductor bar mounted in the body extending generally along the bar-shaped core and outside the first and second windings for providing a circuit for the magnetic flux within the body for preventing the magnetic flux from extending into articles outside the body.

2. The spray device of claim 1 in which the magnetic conductor bar has substantially the same length as the bar-shaped core of the bar transformer.

3. The spray device of claim 1 in which each end of the magnetic conductor bar and the adjacent end of the bar-shaped core define a gap, the bar-shaped core, the magnetic conductor and the gaps together defining the magnetic flux circuit.

4. The spray device of claim 1 in which the magnetic conductor bar is a ferrite core.

5. The spray device of claim 1 in which the voltage providing means further comprises a circuit for multiplying and rectifying the voltage provided by the second winding of the bar transformer, the multiplying and rectifying circuit being mounted in the body between the bar transformer and the discharge opening and having an outlet connected to the electrode circuit.

6. The spray device of claim 5 in which the body is cast plastic and in which the bar transformer, the magnetic conductor bar and the multiplying and rectifying circuit are cast in the body.

7. The spray device of claim 5 in which the multiplying and rectifying circuit is a Greinacher circuit for substantially increasing the voltage provided by the second winding and for converting the voltage into DC voltage.

8. The spray device of claim 5 in which the multiplying and rectifying circuit comprises a voltage divider.

9. The spray device of claim 5 in which the multiplying and rectifying circuit comprises components connected between the second winding and the outlet, each component being mounted outside the channel, the components generally being uniformly distributed around the channel.

10. The spray device of claim 1 in which the channel is a tube and the bar-shaped core and the magnetic conductor bar are each mounted in the body with their axes parallel to the axis of the tube.

11. The spray device of claim 10 in which the body has a circular cross-section, the tube being arranged eccentrically to a first side of the center of the circular cross-section, the bar-shaped core being mounted with its axis arranged eccentrically to a second side of the center of the circular cross-section diametrically opposite the first side.

12. The spray device of claim 1 in which the voltage providing means further comprises a plurality of magnetic conductor bars like the first-mentioned magnetic conductor bar, the plurality including the first-mentioned magnetic conductor bar.

13. The spray device of claim 12 in which the body has a polygonal cross-section.

14. The spray device of claim 12 in which the body has a circular cross-section having two flattened sides parallel to each other.

15. The spray device of claim 12 in which the plurality is two magnetic conductor bars, the two bars being spaced apart from each other for facilitating heat discharge.

16. The spray device of claim 15 in which the channel is a tube and the body has a circular cross-section, the tube being arranged eccentrically to a first side of the center of the circular cross-section, the bar-shaped core being mounted with its axis arranged eccentrically to a second side of the center of the circular cross-section diametrically opposite the first side.

17. The spray device of claim 15 in which the two bars are mounted with an angular spacing of less than 180° from each other, with reference to the axis of the bar-shaped core as vertex, on a side of the bar-shaped core opposite the channel.

* * * * *